US006038772A

United States Patent [19]

Cornell et al.

[11] Patent Number: 6,038,772

[45] **Date of Patent: *Mar. 21, 2000**

[54] EDGING SCISSORS WITH GUIDES

[75] Inventors: Robert W. Cornell, Schofield, Wis.; Suk Ku An, Gyunggido, Rep. of Korea

[73] Assignee: Fiskars Inc., Madison, Wis.

[ * ] Notice: This patent is subject to a terminal disclaimer.

[21] Appl. No.: 09/183,126

[22] Filed: Oct. 30, 1998

Related U.S. Application Data

[63] Continuation of application No. 08/666,939, Jun. 19, 1996, Pat. No. 5,832,612.

[51] Int. Cl.[7] ..... B26B 13/04; B26B 13/10

[52] U.S. Cl. ..... 30/233; 30/229; 30/260

[58] Field of Search ..... 30/229, 233, 230, 30/260, 178

[56] References Cited

U.S. PATENT DOCUMENTS

| | | |
|---|---|---|
| 58,183 | 9/1866 | Whitlock et al. . |
| 249,818 | 11/1881 | Bailey et al. . |
| D. 258,042 | 1/1981 | Backstrom . |
| D. 361,026 | 8/1995 | Ramsey . |
| D. 368,418 | 4/1996 | Aida . |
| 384,710 | 6/1888 | Peters . |
| 1,251,101 | 12/1917 | Quigley . |
| 4,106,195 | 8/1978 | Berg ..... 30/233 X |
| 4,227,305 | 10/1980 | Newman ..... 30/233 X |
| 4,850,110 | 7/1989 | Meier . |
| 4,876,795 | 10/1989 | Chung-cheng . |

FOREIGN PATENT DOCUMENTS

| | | |
|---|---|---|
| 38-7798 | of 0000 | Japan . |
| 7-178260 | 7/1995 | Japan . |
| 9-98962 | 4/1996 | Japan . |
| 8-131667 | 5/1996 | Japan . |
| 1514169 | 12/1974 | United Kingdom . |

*Primary Examiner*—Douglas D. Watts
*Attorney, Agent, or Firm*—Michael D. Rechtin; Foley & Lardner

[57] ABSTRACT

A pivoted hand tool, such as a scissors, includes a pair of blades having non-rectilinear cutting edges to form various cutting patterns on a sheet of paper. The scissors also include at least one guide to control the angular presentation of the paper to the blades and limit the amount of paper presented to the blades. The guide may also include a pair of ridges spaced apart from a pair of abutting surfaces, thereby providing a way to further limit the amount of paper presented to the blades. The scissors preferably have identically-shaped handles and oppositely facing guides to enable a user to create several complementary patterns on the sheet of paper simply by reversing the position in which the scissors are held.

20 Claims, 5 Drawing Sheets

EDGING SCISSORS WITH GUIDES

This application is a continuation of U.S. Ser. No. 08/666,939, filed Jun. 19, 1996 now U.S. Pat. No. 5,832,612.

FIELD OF THE INVENTION

The present invention relates generally to pivoted hand tools, such as scissors, having guides to control the angular presentation of a piece of paper to the blades.

BACKGROUND OF THE INVENTION

Pivoted hand tools, such as scissors, are widely used. For accuracy and convenience, certain scissors are commonly provided with a guide attached to one of the blades to enable a user to more precisely position the material to be cut relative to the blades. An example of a pair of scissors having a guide is illustrated in U.S. Pat. No. 384,710 issued on Jun. 19, 1888 to Peters. Peters discloses a scissors for cutting button holes. The scissors include an upper jaw having a cutter knife configured to an elongated slot in a piece of cloth, and a lower jaw to which an adjustable gage is attached. While relatively simple in construction, adjusting the guide requires a user to stop cutting, loosen a bolt, slide the guide to another desired position, tighten the bolt, and then resume cutting.

Another example of a pair of scissors having a guide is illustrated in U.S. Pat. No. 1,251,101 issued on Dec. 25, 1917 to Quigley. Quigley discloses a pair of scissors with a guide for severing tape into portions at right angles to its length. The channel-shaped guide, which is secured to one of the blades to control the presentation of the tape to the blades, includes opposed, parallel guiding flanges extending at right angles to the line of cut. Although the guide assists the user in cutting straight lines, it is not adjustable for cutting tape substantially smaller or larger than the width of the channel. Additionally, the guide is not provided with any means for controlling the length of the tape to be cut.

U.S. Pat. No. 4,227,305 issued on Oct. 14, 1980 to Newman discloses a pair of scissors having a channel-shaped guide and a measuring gauge primarily adapted for cutting blind strips so as to provide a finished end at the cut end of the strip. The guide, which is attached to one side of one of the blades, has a flat bottom surface bounded by side flanges. The measuring gauge, which is secured to the other side of the same blade, includes a scale and a stop slidably received in an elongated slot formed in the gauge. The user can align the stop with a graduation on the scale and then secure the stop at that position. Although the gauge is adjustable, the guide is not configured to cut pieces of a width other than that of the channel-shaped guide. Furthermore, the scissors of Newman includes a significant number of components, thereby increasing the cost of such an item.

Finally, another example of a pair of scissors including a guide is illustrated in U.S. Pat. No. Des. 368,418 issued on Apr. 2, 1996 to Aida. The scissors in Aida are apparently designed to cut tape.

While, as discussed in the foregoing, certain prior art scissors are provided with guides of various configurations, most of these scissors do not allow the user to cut a corner portion of a sheet of paper or other material. As for the scissors illustrated in the Aida patent, they do not seem to include features permitting the user to adjust the amount of material being cut. Thus, it appears desirable to provide a pair of scissors that alleviate some of the shortcomings associated with conventional prior art items, but which are nevertheless engineered such that they can be of relatively low cost.

SUMMARY OF THE INVENTION

The present invention features a scissors or other pivoted hand tool configured to allow the user to cut different patterns on the corner of a sheet of paper or the like. According to one aspect of the present invention, the scissors comprise first and second opposed elongated members, each member having a blade and a handle disposed across a common pivot point. At least one of the members is provided with a guide configured to control the amount of paper or other material presented to the blades.

According to another aspect of the present invention, both members include a guide. Each guide, which is connected to the outer face of a respective member, includes a pair of abutting surfaces forming an included angle therebetween.

According to a preferred embodiment of the present invention, the guides are formed integrally with the elongated members. Each guide also comprises a bottom plate from which project the abutting surfaces, and a pair of ridges spaced apart from the abutting surfaces. The guides are disposed oppositely facing so that in combination with symmetrical handles the user can create four different patterns on the sheet of paper simply by reversing the position in which the scissors are held.

Other advantages of the present invention will become apparent from the detailed description given hereinafter. It should be understood, however, that the detailed description and specific embodiments are given by way of illustration only since, from the detailed description, various changes and modifications within the spirit and scope of the invention will become apparent to those skilled in the art.

BRIEF DESCRIPTION OF THE DRAWINGS

The preferred exemplary embodiment of this invention will hereinafter be described in conjunction with the appended drawings, wherein like numerals denote like elements and.

DETAILED DESCRIPTION OF A PREFERRED EXEMPLARY EMBODIMENT

Figure 1:
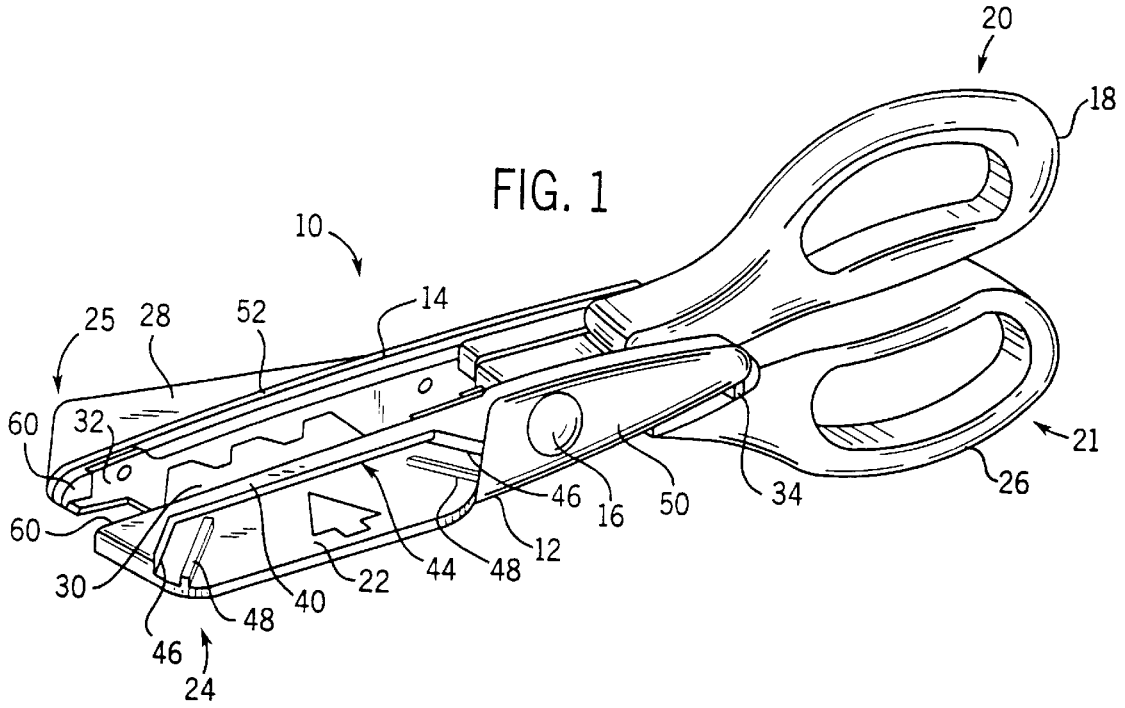
FIG. 1 is a perspective view of an Edging Scissors with Guides in accordance with the invention, shown in the closed position.

The invention relates to pivoted hand tools, such as scissors, having guides to assist the user in cutting a desired portion of a sheet of paper or other suitable material, and to form a particular pattern on the edge being cut. Those skilled in the art will, nevertheless, appreciate that the device described herein and its principle of operation, is broadly applicable to a wide variety of pivoted hand tools, and may be adapted to devices other than scissors. Accordingly, while the present invention is hereinafter described with particular reference to a pair of scissors, the skilled artisan will readily appreciate its many other applications.

Referring to the Figures, a scissors 10 according to the invention includes first and second opposed elongated members 12 and 14, respectively, preferably made of moldable material such as plastic, joined for scissor-action about a pivot joint 16. Member 12 comprises a first handle 18 at a rear end 20, and a first guide 22 at a front end 24. Similarly, member 14 comprises a second handle 26 at a rear end 21 and a second guide 28 at a front end 25. Scissors 10 also includes blades 30 and 32 which are respectively attached to members 12 and 14. As more particularly shown in FIG. 4, blade 30 has a cutting edge which is non-rectilinear. Necessarily, blade 32 which must matingly engage blade 30 has a pattern which is complementary to that of blade 30. Each member 12, 14 also includes a stop, 34, 36, that is integrally molded therewith. Stops 34 and 36 limit the scissor movement of members 12 and 14 after handles 18 and 26 are closed together in the process of cutting a piece of paper 15.

Figure 2:
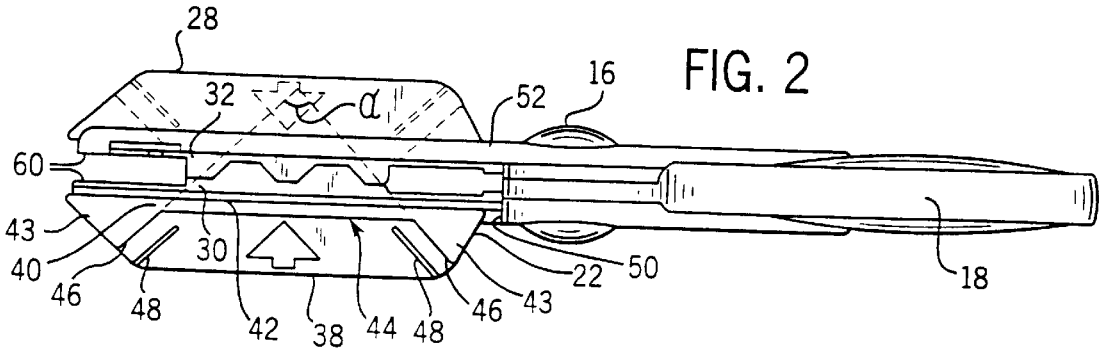
FIG. 2 is a top plan view of the edging scissors shown in FIG. 1.
Figure 3:
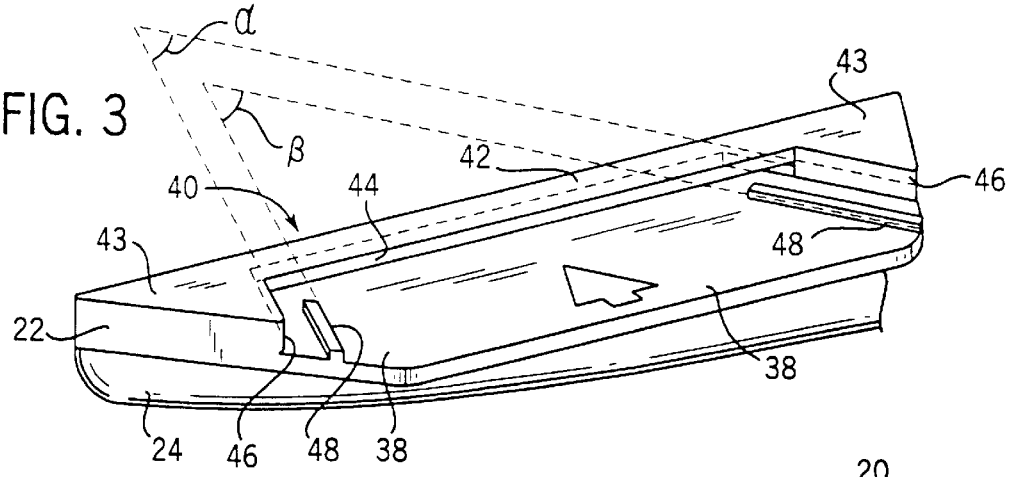
FIG. 3 is a perspective view of the guide of the scissors shown in FIG. 1.
Figure 4:
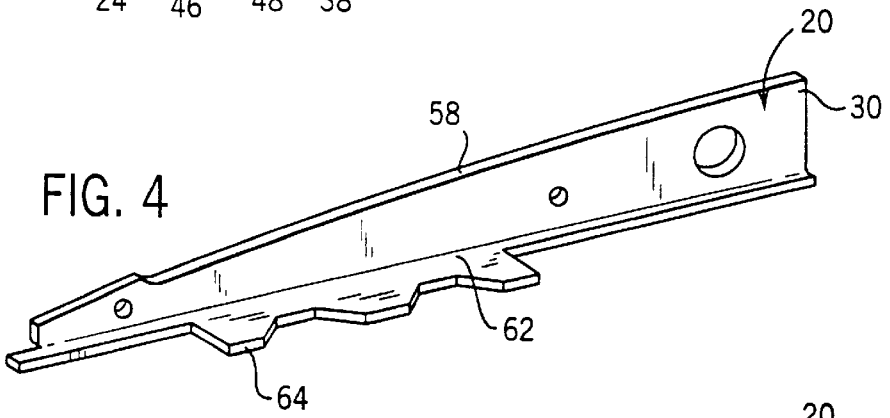
FIG. 4 is a perspective view of one of the non-rectilinear blades associated with the scissors of FIG. 1.
Figure 5:
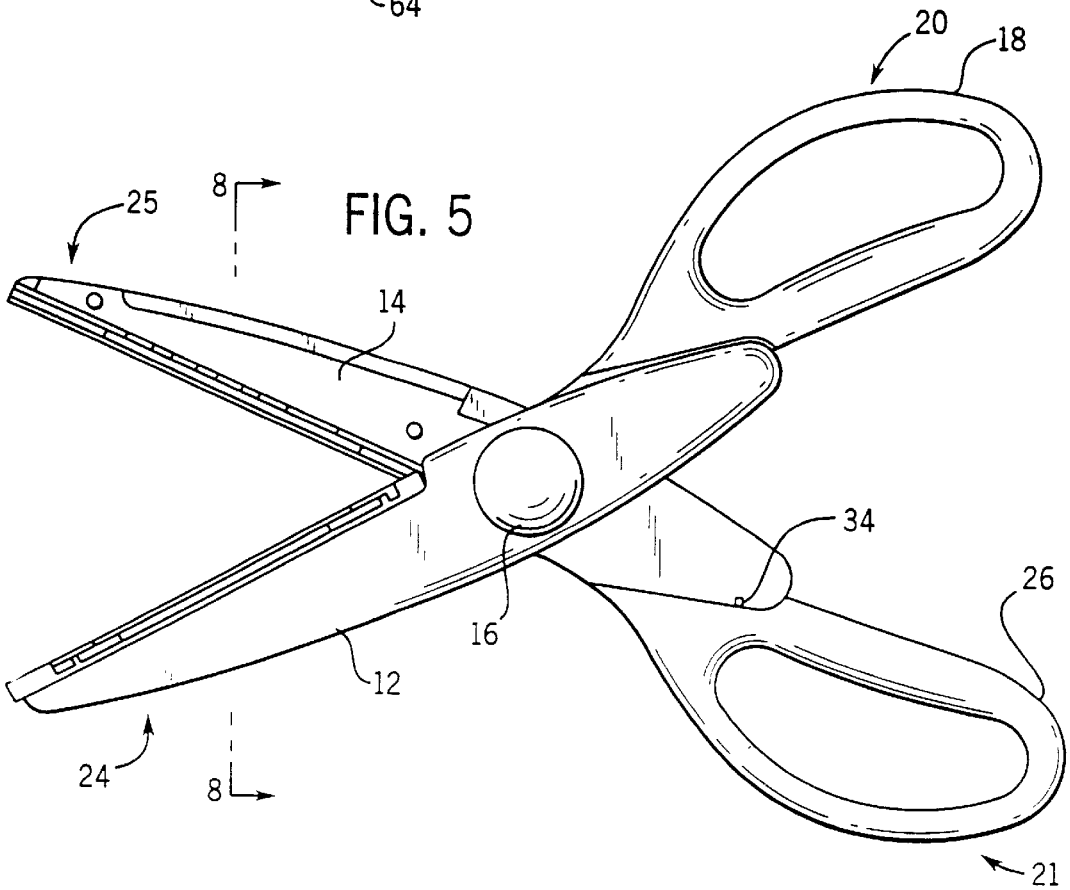
FIG. 5 is a front elevational view of the scissors of FIG. 1, shown in the open position.

Referring more particularly to FIGS. 2–4, first guide 22 includes a bottom plate 38 and a cover plate 40 having a strip 42 extending between a pair of substantially triangular posts 43 attached to bottom plate 38. Strip 42 forms a slot 44 between a portion of bottom plate 38 and cover plate 40. Posts 43 include a pair of abutting surfaces 46 extending from bottom plate 38 to cover plate 40.

Figure 14:
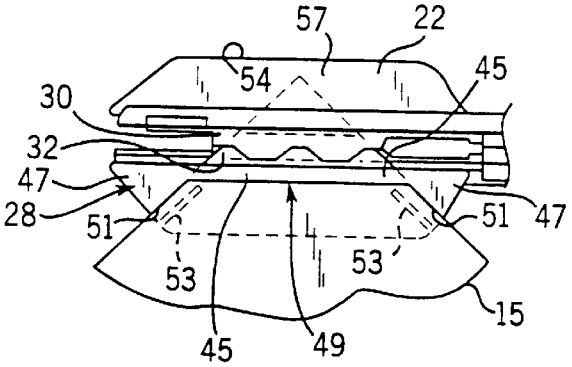
FIG. 14 is a partial top plan view of the scissors of FIG. 1, the scissors being held in a second position and being shown with a piece of paper abutting against the abutting surfaces.
Figure 15:
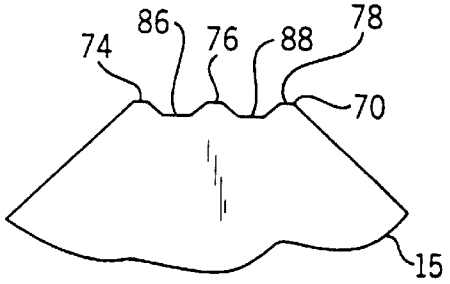
FIG. 15 is a partial top plan view of the sheet of paper, illustrating a third edge resulting from the cut formed when the paper is inserted in the guide with the scissors held by the user as shown in FIG. 14.
Figure 16:
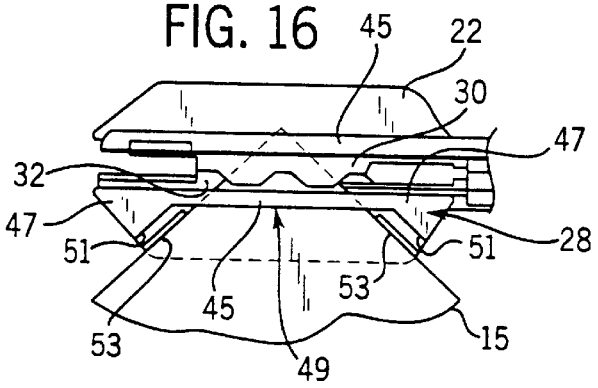
FIG. 16 is a partial top plan view of the scissors of FIG. 1, the scissors being held in a second position and being shown with a piece of paper abutting against the ridges.

Similarly, as illustrated in FIGS. 14 and 16, second guide 28 includes a bottom plate 39 and a cover plate 41 having a strip 45 extending between a pair of substantially triangular posts 47 attached to bottom plate 39. Strip 45 forms a slot 49 between a portion of bottom plate 39 and cover plate 41. Posts 47 include a pair of abutting surfaces 51 extending from bottom plate 39 to cover plate 41. Referring to FIG. 3, an included angle a is formed at the point of intersection of a pair of lines aligned with abutting surfaces 46. The same included angle a is formed at the point of intersection of a pair of lines aligned with abutting surfaces 51 on second guide 28.

Guides 22, 28 include ridges 48, 53, respectively, advantageously integrally formed in pairs with bottom plates 38, 39, respectively, and extending from bottom plate 38, 39 by a predetermined distance. Ridges 48, 53 are spaced apart and substantially parallel to abutting surfaces 46, 51. Thus, an included angle β formed at the point of intersection of a pair of lines aligned with ridges 48, 53 is equal to included angle a formed at the point of intersection of the lines aligned with abutting surfaces 46, 51. Because ridges 48, 53 do not extend beyond respective strips 42, 45, a user may guide paper 15 over ridges 48, 53 and through slots 44, 49 until paper 15 abuts against abutting surfaces 46, 51.

Figure 10:
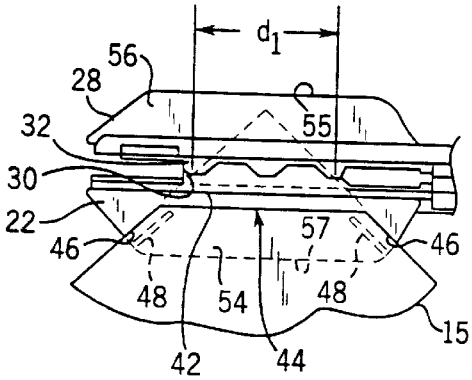
FIG. 10 is a partial top plan view of the scissors of FIG. 1, the scissors being held in a first position and being shown with a piece of paper abutting against the abutting surfaces.

First guide 22 is connected to an outer face 50 of member 12. Guide 22 is preferably integrally molded with member 12. Similarly, second guide 28 is connected to an outer face 52 of member 14 with which it is preferably integrally molded. Guides 22 and 28 are preferably structurally identical, but are oppositely facing each other when formed with members 12 and 14. As illustrated in FIGS. 10 and 14, first guide 22 has a top surface 54 and a bottom surface 57 while second guide 28 has a top surface 55 and a bottom surface 56.

Figure 9:
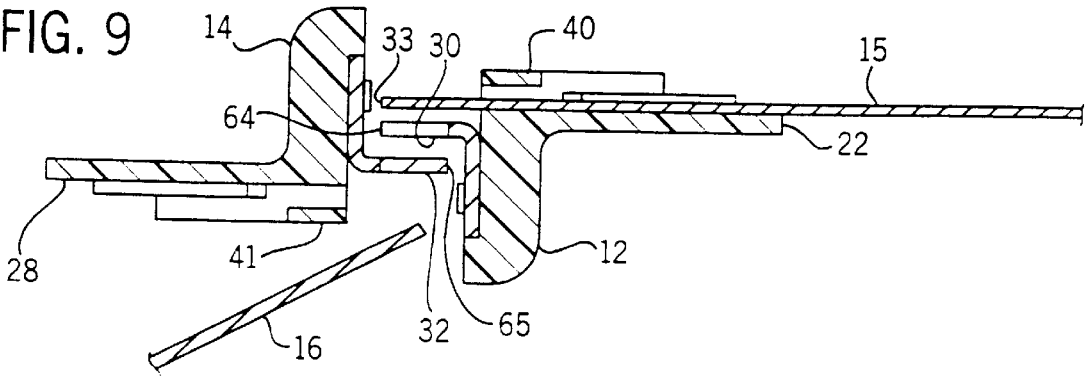
FIG. 9 is a partial sectional view of the scissors taken along line 8—8 shown in FIG. 5, the blades being shown having cut the sheet of paper fed through the guide.
Figure 8:
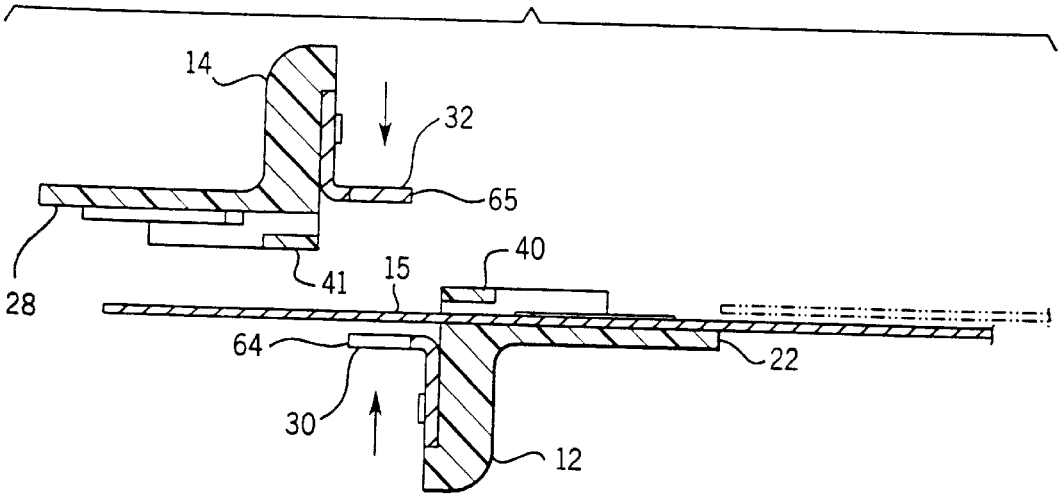
FIG. 8 is a partial sectional view of the scissors taken along line 8—8 shown in FIG. 5, the blades being shown about to cut a sheet of paper fed through the guide.

Referring more particularly to FIGS. 4, 8, and 9, blades 30 and 32 are substantially L-shaped and include first portions 58 attached to respective inner faces 60 of members 12 and 14 and second portions 62 having matingly engageable non-rectilinear cutting edges 64, 65. As used herein, non-rectilinear edges 64, 65 include any edge which is not straight such as for example edges with pinking or scalloped patterns, or any other edge that is not a straight line thereby allowing a user to create a decorative pattern. Patterned edge 64 of blade 30 is complementary to patterned edge 65 of blade 32. As explained in greater detail below, the patterns formed on a corner of paper 15 will be different, depending on whether the user guides paper 15 against abutting surfaces 46, 51 or ridges 48, 53.

Figure 17:
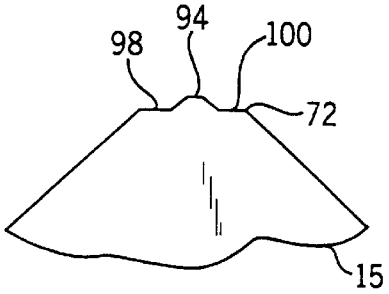
FIG. 17 is a partial top plan view of the sheet of paper, illustrating a fourth edge resulting from the cut formed when the paper is inserted in the guide with the scissors held by the user as shown in FIG. 16.

FIGS. 11, 13, 15, and 17 show the patterns created on paper 15 depending on whether the user uses surfaces 46, 51, or ridges 48, 53, and further depending on whether paper 15 is inserted in first guide 22 or second guide 28. Specifically, when paper 15 is inserted in first guide 22 against abutting surfaces 46 a first pattern 66 (FIG. 11) is formed; still holding scissors 10 in the same position, second pattern 68 (FIG. 13) is created when paper 15 abuts against ridges 48. To create two additional patterns, paper 15 is inserted in second guide 28 against abutting surfaces 51 to form a third pattern 70 (FIG. 15) or against ridges 53 to form a fourth pattern 72 (FIG. 17).

Figure 6:
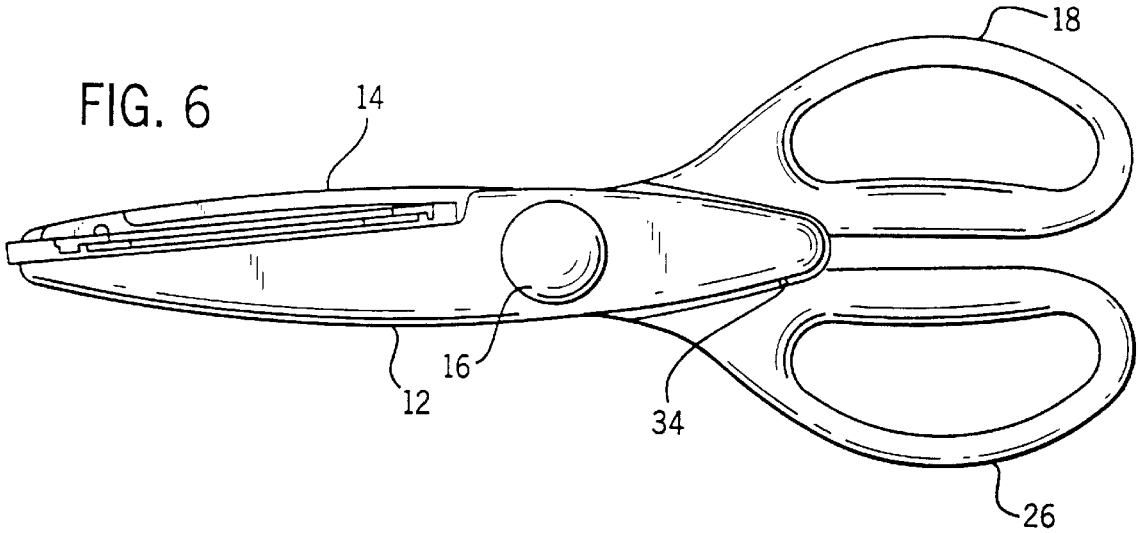
FIG. 6 is a front elevational view of the scissors of FIG. 1, shown in the closed position.
Figure 7:
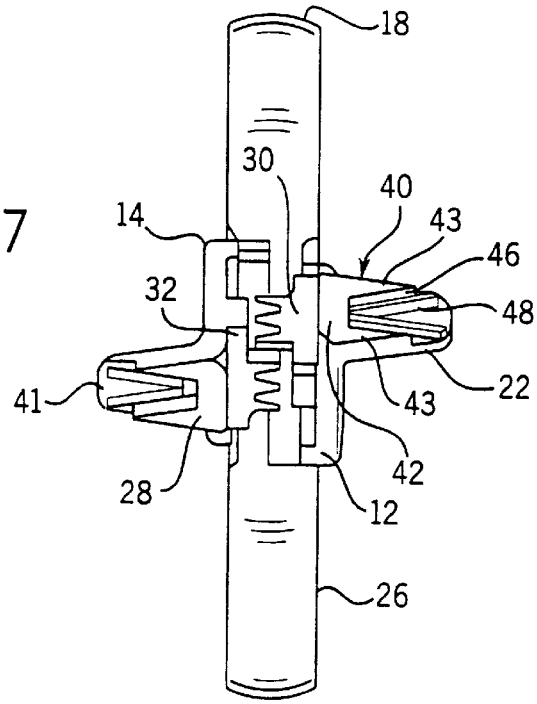
FIG. 7 is a sectional view of the scissors taken along line 7—7 shown in FIG. 6.

Referring now to FIGS. 6 and 7, handles 18 and 26 are substantially identical to allow the user to cut paper 15 with either hand. Paper 15 is inserted in first guide 22 and cut when the user closes handles 18 and 26 with the user's thumb actuating handle 18 and the user's four fingers actuating handle 26. Because handles 18 and 26 have the same configuration, the user can then cut another piece of paper 15 with the same hand using second guide 28. This is achieve simply by flipping scissors 10 around, so that the user's thumb now actuates handle 26 and the user's four fingers actuate handle 18. Paper 15 is then inserted in second guide 28 and cut when the user closes handles 18 and 26.

Stated another way, because handles 18 and 26 conveniently have the same configuration, and because guides 22 and 28 which are disposed in oppositely facing configuration are substantially identical, the user is able to create complementary patterns on paper 15 by reversing the position of scissors 10. In addition, combined with the fact that the amount of paper 15 presented to cutting edges 64, 65 can be controlled to two distinct positions by guiding paper 15 against abutting surfaces 46, 51 or ridges 48, 53, the user is able to create four different patterns 66, 68, 70, 72 on the corners of paper 15.

FIGS. 8 and 9 illustrate blades 30 and 32 cutting paper 15. With the scissors in an open position, a piece of paper is guided against abutting surfaces 46 or ridges 48 through slot 44 until paper 15 extends at least beyond blade 32. The user closes handles 18 and 26 together, thereby creating a patterned edge 33 on paper 15 with non-rectilinear blades 30 and 32. A severed piece of paper 16 drops away from scissors 10 in a downwardly direction indicated by the arrow in FIG. 9. As mentioned above, patterned edge 33 varies depending on whether paper 15 is presented to blades 30, 32 against abutting surfaces 46 or ridges 48 of first guide 22 or against abutting surfaces 51 or ridges 53 of second guide 28.

Figure 11:
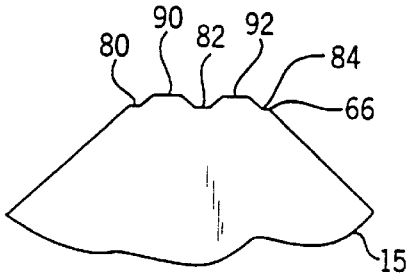
FIG. 11 is a partial top plan view of the sheet of paper, illustrating a first edge resulting from the cut formed when the paper is inserted in the guide with the scissors held by the user as shown in FIG. 10.
Figure 12:
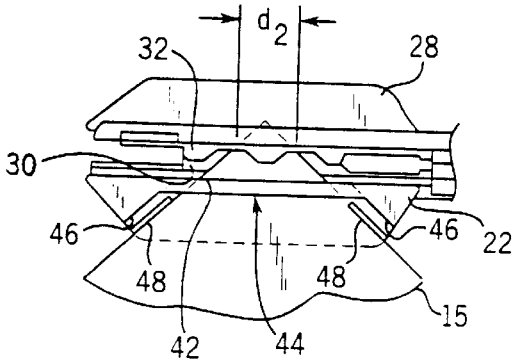
FIG. 12 is a partial top plan view of the scissors of FIG. 1, the scissors being held in a first position and being shown with a piece of paper abutting against the ridges.
Figure 13:
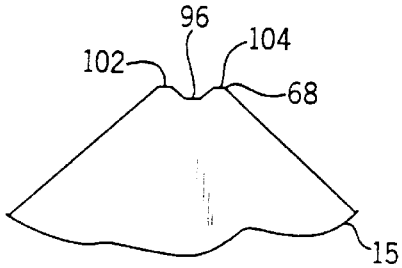
FIG. 13 is a partial top plan view of the sheet of paper, illustrating a second edge resulting from the cut formed when the paper is inserted in the guide with the scissors held by the user as shown in FIG. 12.

We now review more specifically the different patterns created by using the symmetry of handles 18, 26 and the oppositely facing configuration of guides 22, 28. In FIGS. 10 and 11, a corner of paper 15 is guided against abutting surfaces 46 of guide 22 through slot 44 and cut by blades 30 and 32. Non-rectilinear blades 30 and 32 form first edge 66 along the length of paper 15 presented to blades 30 and 32 represented by $d_1$. Alternatively, as shown in FIGS. 12 and 13, the user can guide paper 15 against ridges 48 of guide 22 through slot 44 instead of against abutting surfaces 46 to create second edge 68 with non-rectilinear blades 30 and 32. The length of paper 15 presented to blades 30 and 32 against ridges 48 is represented by $d_2$ which is less than $d_1$. Second edge 68 which has length $d_2$ is identical to a portion of first edge 66 having length $d_1$.

Similarly, referring to FIGS. 14–17, the user can turn scissors 10 over and guide a corner of paper 15 against abutting surfaces 51 of guide 28 through slot 49 and cut paper 15 with non-rectilinear blades 30 and 32, thereby creating third edge 70. The user can also guide paper 15 against ridges 53 of guide 28 through slot 49 instead of against abutting surfaces 51 and cut paper 15 with non-rectilinear blades 30 and 32 to form fourth edge 72. Again, fourth edge 72 which also has length $d_2$ is identical to a portion of third edge 70 which has a length $d_1$.

Referring to FIGS. 11, 13, 15 and 17, third edge 70 is the opposite of first edge 66, and fourth edge 72 is the opposite of second edge 68. In other words, every protrusion 74, 76 and 78 in third edge 70 has a corresponding cavity 80, 82 and 84 in first edge 66. This is caused by the mating engagement of complementary blades 30, 32 and patterned edges 64, 65, respectively. Therefore, every cavity 86 and 88 in third edge 70 also has a corresponding protrusion 90 and 92 in first edge 66. As illustrated in FIGS. 13 and 17, second edge 68 is identical to a portion of first edge 66 and fourth edge 72 is identical to a portion of third edge 70, so that protrusion 94 in fourth edge 72 has a corresponding cavity 96 in second edge 68 and every cavity 98 and 100 in fourth edge 72 has a corresponding protrusion 102 and 104 in second edge 68.

As one can readily appreciate, opposite patterns 66, 70 and 68, 72 can be created with any pair of non-rectilinear blades. The pattern on one of the blades will necessarily be complementary to the pattern on the other blade for the blades to matingly engage. This particular relationship allows the user to create four different patterns 66, 68, 70, 72 provided scissors 10 also include two identical guides 22, 28.

It is understood that the above description is of a preferred exemplary embodiment of the invention, and that the invention is not limited to the specific forms described. Those skilled in the art will appreciate that, for example, pivoted hand tools with guides in accordance with the invention could comprise blades 30 and 32 with different non-rectilinear or linear edges. Additional ridges can also be provided on bottom plates 38, 39 to guide paper 15 and guides 22 and 28 can be modified to eliminate cover plates 40, 41. Such modifications and other configurations are, nevertheless, considered to be within the scope of this invention. Thus, these and other substitutions, modifications, changes and omissions may be made in the design and arrangement of the elements without departing from the scope of the appended claims.

What is claimed is:

1. A pivoted hand tool having first and second opposed elongated members, each member having a blade at a front end thereof and a handle at a rear end thereof, each blade having a cutting edge, a pivot uniting the elongated members for pivotal movement thereabout, the cutting edges being matingly engageable upon pivotal movement of the handles about the pivot, the hand tool improvement comprising:

a guide connected to the front end of at least the first member, the guide including a bottom plate spaced apart from a cover plate, the cover plate extending across at least a portion of the bottom plate to form a slot therewith, and abutting surfaces forming an included angle therebetween.

2. The hand tool of claim 1 wherein the improvement further includes a guide with a pair of ridges connected to the bottom plate and spaced apart from the abutting surfaces, and wherein the ridges are formed integrally with the bottom plate.

3. A pivoted hand tool having first and second opposed elongated members, each member having a blade at a front end thereof and a handle at a rear end thereof, each blade having a cutting edge, a pivot uniting the elongated members for pivotal movement thereabout, the cutting edges being matingly engageable upon pivotal movement of the handles about the pivot, the hand tool improvement comprising:

a first guide connected to the front end of at least the first member, the first guide including a bottom plate spaced apart from a cover plate, the cover plate extending across at least a portion of the bottom plate to form a slot therewith, the second elongated member having a second guide.

4. The hand tool of claim 3 wherein the guides are disposed oppositely facing.

5. The hand tool of claim 3, wherein the first guide is identical to the second guide.

6. A pivoted hand tool comprising:

first and second opposed elongated members, each member having a blade at a front end thereof and a handle at a rear end thereof;

a pivot uniting the elongated members for pivotal movement thereabout, the blades being matingly engageable upon pivotal movement of the handles about the pivot; and a guide connected to the front end of at least the first member, the guide including a bottom plate spaced apart from a cover plate, a pair of abutting surfaces extending from the bottom plate, the abutting surfaces forming an included angle therebetween, the cover plate extending across at least a portion of the bottom plate to form a slot therewith.

7. A pivoted hand tool comprising:

first and second opposed elongated members, each member having a blade at a front end thereof and a handle at a rear end thereof;

a pivot uniting the elongated members for pivotal movement thereabout, the blades being matingly engageable upon pivotal movement of the handles about the pivot;

a first guide connected to the front end of at least the first member, the first guide including a bottom plate spaced apart from a cover plate, a pair of abutting surfaces extending from the bottom plate, the cover plate extending across at least a portion of the bottom plate to form a slot therewith, and the second elongated member including a second guide.

8. The hand tool of claim 7 wherein the guides are disposed oppositely facing.

9. The hand tool of claim 7, wherein the first guide is identical to the second guide.

10. A pivoted hand tool comprising:

first and second opposed elongated members, each member having a blade at a front end thereof and a handle at a rear end thereof;

a pivot uniting the elongated members for pivotal movement thereabout; and a first guide connected to the front end of at least the first member, the first guide including a bottom plate spaced apart from a cover plate, the cover plate extending across at least a portion of the bottom plate to form a slot therewith, and a second guide connected to the second member.

11. The hand tool of claim 10, wherein the first guide is identical to the second guide.

12. The hand tool of claim 10, wherein the blades have matingly engaging non-rectilinear cutting edges.

13. The hand tool of claim 10 wherein the first guide is formed integrally with the first member and the second guide is formed integrally with the second member.

14. The hand tool of claim 10, wherein the handle of the first member is symmetrical to the handle of the second member.

15. The hand tool of claim 10 wherein at least one of the guides includes a bottom plate having a pair of abutting surfaces forming an included angle therebetween.

16. The hand tool of claim 15 wherein the bottom plate further includes a pair of ridges extending from the bottom plate by a predetermined distance.

17. The hand tool of claim 16 wherein the ridges are spaced apart from, and substantially parallel to, the abutting surfaces.

18. The hand tool of claim 10 wherein each blade is substantially L-shaped and includes first and second portions, each blade first portion being attached to a respective inner face and the second portions having matingly engageable non-rectilinear cutting edges.

19. The hand tool of claim 18 wherein the first guide includes a strip extending between a pair of posts connected to the bottom plate of the first guide, proximate the inner face of the first member.

20. A pivoted hand tool comprising:

first and second opposed elongated members, each member having a blade at a front end thereof and a handle at a rear end thereof;

a pivot uniting the elongated members for pivotal movement thereabout;

a first guide connected to the front end of at least the first member, the first guide including a bottom plate spaced apart from a cover plate, the cover plate extending across at least a portion of the bottom plate to form a slot therewith, the blades having matingly engaging non-rectilinear cutting edges wherein the non-rectilinear cutting edges produce different patterns on paper dependent upon whether the paper is placed against abutting surfaces or ridges; and a second guide included with the second elongated member.

* * * * *